US011791600B2

(12) United States Patent
Schuster et al.

(10) Patent No.: US 11,791,600 B2
(45) Date of Patent: Oct. 17, 2023

(54) BARREL CRIMP RETENTION FEATURE FOR CONNECTOR WITH BRAIDED WIRE

(71) Applicant: APTIV TECHNOLOGIES LIMITED, St. Michael (BB)

(72) Inventors: James P. Schuster, Vienna, OH (US); William J. Palm, Warren, OH (US); Michael Messuri, Canfield, OH (US); Jared Bilas, North Bloomfield, OH (US); Dominic A. Messuri, Canfield, OH (US); Leslie Jones, Garrettsville, OH (US); Gert Droesbeke, Erkrath (DE)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 35 days.

(21) Appl. No.: 17/544,037

(22) Filed: Dec. 7, 2021

(65) Prior Publication Data

US 2022/0190539 A1 Jun. 16, 2022

Related U.S. Application Data

(63) Continuation-in-part of application No. 17/123,840, filed on Dec. 16, 2020, now Pat. No. 11,462,875.

(51) Int. Cl.

| | |
|---|---|
| ***H01R 43/048*** | (2006.01) |
| ***H01R 24/56*** | (2011.01) |
| ***H01B 7/22*** | (2006.01) |

(52) U.S. Cl.

CPC ..... *H01R 43/048* (2013.01); *H01B 7/228* (2013.01); *H01R 24/568* (2013.01); *H01R 2201/26* (2013.01)

(58) Field of Classification Search

CPC ..... H01R 43/048; H01R 24/568; H01R 2201/26; H01B 7/228

(Continued)

(56) References Cited

U.S. PATENT DOCUMENTS 3,670,293 A * 6/1972 Garver ..... H01R 9/0518 439/585
4,719,697 A 1/1988 Schwartzman et al.

(Continued)

FOREIGN PATENT DOCUMENTS

DE 19850883 A1 * 6/1999
DE 10004813 A1 * 8/2000

(Continued)

OTHER PUBLICATIONS

European Search Report for European Application No. 21214779.7 dated May 6, 2022.

*Primary Examiner* — Peter G Leigh
(74) *Attorney, Agent, or Firm* — Carlson, Gaskey & Olds, P.C.

(57) ABSTRACT

A cable assembly includes coaxially arranged inner and outer barrels. The outer barrel overlaps a portion of the inner barrel. The inner and outer barrels respectively include first and second features that cooperate with one another to form a retention feature. The cable assembly has a cable that has at least one wire surrounded by an inner insulator that is covered in a metallic shield. The metallic shield is arranged in between the inner and outer barrels. The first feature is arranged beneath the metallic shield, and the second feature is arranged over the metallic shield. At least one of the first and second features extends in a radial direction relative to the other of the first and second features to capture the metallic shield with the retention feature.

17 Claims, 8 Drawing Sheets

(58) Field of Classification Search
USPC ..... 439/153
See application file for complete search history.

(56) References Cited

U.S. PATENT DOCUMENTS

| | | | | |
|---|---|---|---|---|
| 5,603,636 | A * | 2/1997 | Kanou | H01R 43/0482 439/585 |
| 5,997,335 | A * | 12/1999 | Kameyama | H01R 9/053 439/668 |
| 6,083,034 | A * | 7/2000 | Kameyama | H01R 9/0518 439/394 |
| 6,217,381 | B1 * | 4/2001 | Kameyama | H01R 9/0518 439/578 |
| 6,231,387 | B1 * | 5/2001 | Kameyama | H01R 9/05 439/578 |
| 6,692,299 | B1 | 2/2004 | Stockmaster | |
| 6,951,483 | B2 * | 10/2005 | Kameyama | H01R 9/0518 439/99 |
| 7,318,742 | B2 * | 1/2008 | Morikawa | H01R 9/0518 174/75 C |
| 7,632,144 | B2 * | 12/2009 | Sakaguchi | H01R 9/0518 439/585 |
| 7,819,694 | B2 | 10/2010 | Miyashita et al. | |
| 8,011,954 | B2 * | 9/2011 | Nagafuchi | H01R 9/0518 439/585 |
| 9,325,082 | B2 * | 4/2016 | Furukawa | H01R 13/646 |
| 9,660,355 | B2 | 5/2017 | Kato et al. | |
| 9,692,146 | B2 | 6/2017 | Justi et al. | |
| 9,793,692 | B1 | 10/2017 | Pogash et al. | |
| 10,069,291 | B2 | 9/2018 | Kitagawa et al. | |
| 10,468,786 | B2 * | 11/2019 | De Cloet | H01R 24/38 |
| 10,594,057 | B2 | 3/2020 | Kanemura et al. | |
| 2004/0203286 | A1 | 10/2004 | Kameyama | |
| 2005/0266727 | A1 * | 12/2005 | Yamaguchi | H01R 9/0518 439/585 |
| 2005/0282434 | A1 * | 12/2005 | Morikawa | H01R 9/0518 439/578 |
| 2009/0035991 | A1 * | 2/2009 | Sakaguchi | H01R 9/0518 439/585 |
| 2009/0098769 | A1 * | 4/2009 | Sakamoto | H01R 9/0518 439/578 |
| 2019/0356061 | A1 | 11/2019 | Masuda et al. | |
| 2019/0356101 | A1 | 11/2019 | Masuda et al. | |
| 2020/0274263 | A1 | 8/2020 | Hashimoto et al. | |

FOREIGN PATENT DOCUMENTS

| | | | |
|---|---|---|---|
| EP | 1126548 | A2 * | 8/2001 |
| EP | 3220483 | A1 | 9/2017 |
| JP | 2000113946 | A * | 4/2000 |
| JP | 2003317882 | A * | 11/2003 |

* cited by examiner

BARREL CRIMP RETENTION FEATURE FOR CONNECTOR WITH BRAIDED WIRE

CROSS-REFERENCE TO RELATED APPLICATION

This application is a Continuation-in-part of U.S. patent application Ser. No. 17/123,840 filed Dec. 16, 2020.

FIELD OF INVENTION

The disclosure relates to a barrel crimp retention feature for a connector used with a shield, such as braided wire.

BACKGROUND

Cables such as those used in high voltage applications or coaxial cables for video typically include a braided shield to prevent interference. Customer demands to meet stringent automotive-grade cable retention requirements is challenging with typical stamped and formed shielded crimp wing designs. That is, the electrical connector may pull away from the shield under design loads. Current cable designs include formed crimped wing geometries that depend upon sustainable compression forces to provide consistent friction forces throughout cable usage. New customer space constraints demand cable designs with thinner materials, making cable design even more challenging.

SUMMARY

In one exemplary embodiment, a cable assembly includes coaxially arranged inner and outer barrels. The outer barrel overlaps a portion of the inner barrel. The inner and outer barrels respectively include first and second features that cooperate with one another to form a retention feature. The cable assembly further includes a cable with at least one wire surrounded by an inner insulator covered in a metallic shield. The metallic shield is arranged in between the inner and outer barrels. The first feature is arranged beneath the metallic shield, and the second feature is arranged over the metallic shield. At least one of the first and second features extends in a radial direction relative to the other of the first and second features to capture the metallic shield with the retention feature.

In a further embodiment of any of the above, the metallic shield is provided by a braided or foil sleeve. One of the inner and outer barrels is secured to an electrical connector having an outer housing. The metallic shield is grounded and secured to the outer housing. The metallic shield is covered in a nonconductive sheathing, and the other of the inner and outer barrels is secured over the nonconductive sheathing.

In a further embodiment of any of the above, the first feature is provided by a flange at a terminal end of the inner barrel that is flared radially outward.

In a further embodiment of any of the above, the second feature is a window and the first feature is arranged within the window. The flange is provided about a circumference of the terminal end. The flange is axially aligned with the window.

In a further embodiment of any of the above, the second feature is a window and the first feature is arranged within the window. The first feature is provided by a protrusion in the inner barrel that is arranged axially inboard of a terminal end. The protrusion is axially and circumferentially aligned with the window.

In a further embodiment of any of the above, the outer barrel includes a crimped portion provided by a plastically deformed area and that generates a clamping force on the metallic shield and the inner barrel.

In a further embodiment of any of the above, a portion of the inner barrel includes an irregularly shaped circumferential edge forming a body. The irregularly shaped circumferential edge has a sheared edge that extends interiorly from the circumferential edge. The first feature is provided by the sheared edge that extends radially outward relative to the body. The sheared edge is axially blocked by the outer barrel to provide the retention feature.

In a further embodiment of any of the above, a portion of the inner barrel includes an irregularly shaped circumferential edge forming a body. The irregularly shaped circumferential edge has a circumferentially extending portion providing an edge. The first feature is provided by the edge extending radially outward relative to the body. The edge is axially blocked by the outer barrel to provide the retention feature.

In a further embodiment of any of the above, the first feature is provided by a window. The second feature is provided by a depression that extends radially inward to the window.

In a further embodiment of any of the above, a portion of the depression provides a sheared edge.

In a further embodiment of any of the above, the sheared edge is arranged inboard from a perimeter of an outer barrel blank.

In a further embodiment of any of the above, the sheared edge is provided between opposing sides of the portion of the depression. Both of the opposing sides extend radially into the window.

In a further embodiment of any of the above, the inner and outer barrels are each metallic cylindrically-shaped or oval shaped members.

In a further embodiment of any of the above, the inner and outer barrels are formed from sheet metal blanks. At least one of the first and second features are provided in the blanks.

In another exemplary embodiment, a method of assembling a cable includes the steps of: a) providing first and second features respectively provided on an inner barrel and an outer barrel, wherein at least one of the first and second features extends in a radial direction relative to the other of the first and second features, b) inserting the cable into the outer barrel, c) inserting an end of the inner barrel underneath a metallic shield, d) aligning the first and second features to provide a retention feature, and e) capturing the metallic shield between the first and second features of the inner and outer barrels and preventing relative axial movement of the inner and outer barrels relative to one another.

In a further embodiment of any of the above, the second feature is a window. Step e) includes crimping the outer barrel adjacent to the window. The first feature is in the window.

In a further embodiment of any of the above, the cable includes at least one wire surrounded by an inner insulator covered in the metallic shield. Step c) includes inserting the end of the inner barrel between the inner insulator and the metallic shield. Step e) includes securing one of the inner and outer barrels to a terminal connector having an outer housing. The metallic shield is grounded to the outer housing. The cable includes a nonconductive sheathing covering the metallic shield. The other of the inner and outer barrels are secured over the nonconductive sheathing.

In a further embodiment of any of the above, step d) includes sliding the outer barrel axially over the inner barrel and the metallic shield.

In a further embodiment of any of the above, prior to performing step a), the method includes a step of a1) forming the first feature by bending a circumferential flange radially outward on a terminal end of an inner barrel blank.

In a further embodiment of any of the above, prior to performing step a), the method includes a step of a1) forming the first feature by deforming a protrusion axially inboard of a terminal end of an inner barrel blank. Step d) includes circumferentially aligning the protrusion with a window providing the second feature.

In a further embodiment of any of the above, step e) includes plastically deforming a portion of the outer barrel to provide an innermost diameter that is less than an outermost diameter of the first feature.

BRIEF DESCRIPTION OF THE DRAWINGS

The disclosure can be further understood by reference to the following detailed description when considered in connection with the accompanying drawings wherein.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible. Like reference numbers and designations in the various drawings indicate like elements.

DETAILED DESCRIPTION

Figure 1:
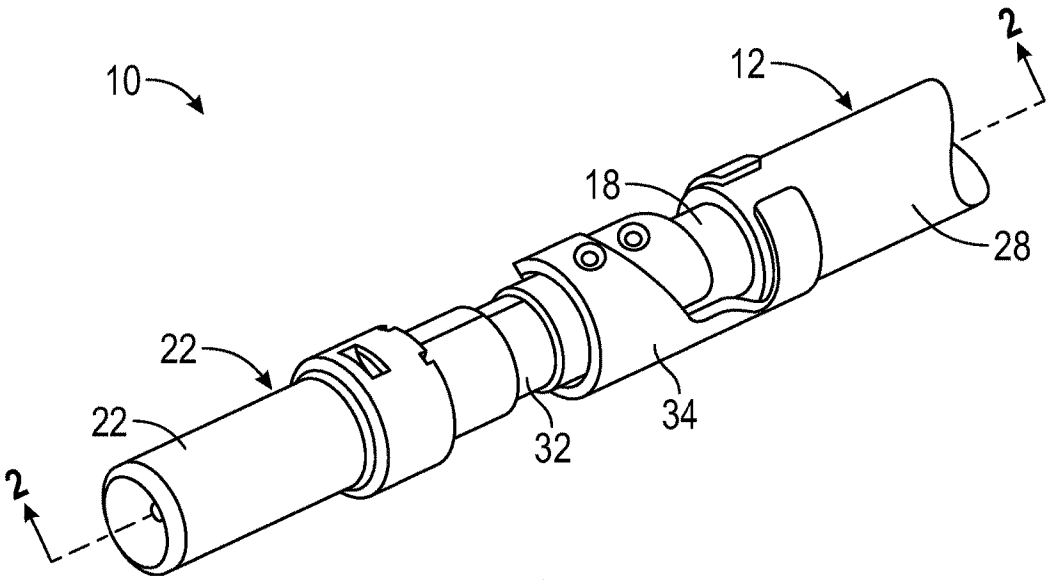
FIG. 1 is a perspective view of a portion of a coaxial cable with a connector.
Figure 2:
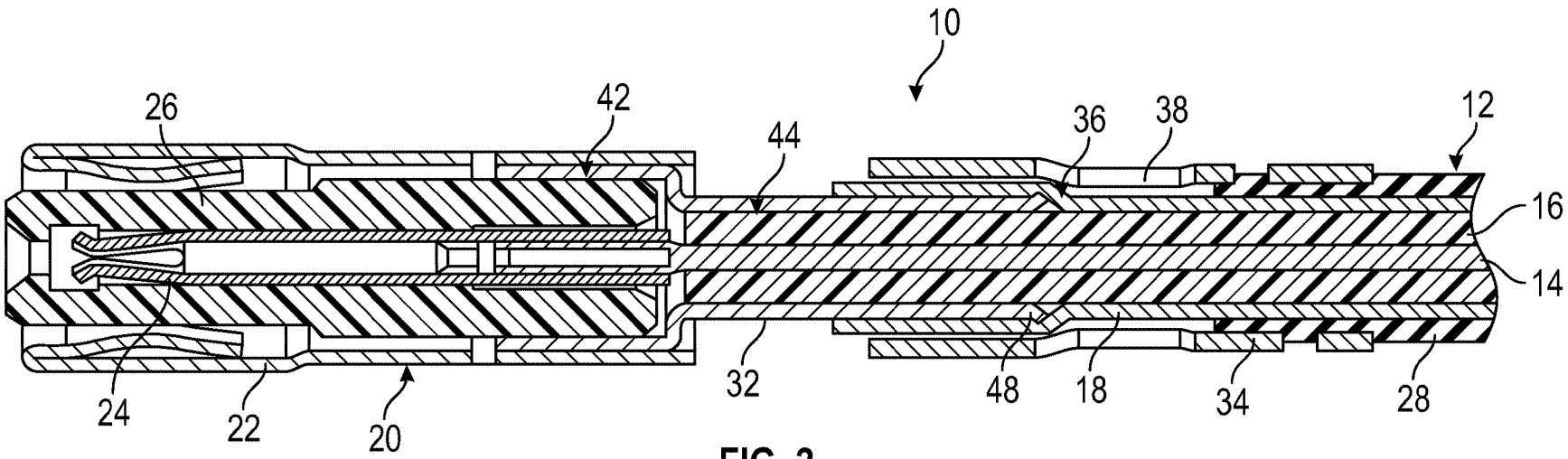
FIG. 2 is a cross-sectional view taken alone line 2-2 of FIG. 1.

A cable assembly is illustrated in FIGS. 1 and 2. The cable assembly 10 includes a coaxial cable 12 having a wire 14 surrounded by an inner insulator 16. The inner insulator is a nonconductive insulative layer. A metallic, conductive shield 18 covers the inner insulator 16. In the example, the shield 18 is a braided or foil sleeve or wire braid that provides RF interference prevention.

A connector 20 is provided at one end of the cable 12. Although the example connector 20 is illustrated as a female connector, the connector 20 may also be a male connector or a splice connector. The connector 20 includes an outer housing 22 that is grounded to the shield 18. An inner nonconductive housing 26 supports an electrical terminal 24 electrically connected to the wire 14. A nonconductive sheathing 28, such as a polymer material, is arranged over the shield 18.

Referring to FIG. 2, inner and outer barrels 32, 34 are arranged coaxially with respect to one another and in at least partially axially overlapping relationship. The inner and outer barrels 32, 34 respectively include first and second features that cooperate with one another to form a retention feature 36 that captures the shield 18 to create a robust electrical connection providing reliable shielding against electromagnetic interference (EMI), for example. In the examples, the first feature is arranged beneath the shield 18, and the second feature is arranged over the shield 18. In order to securely retain the shield 18 once the cable assembly 10 is assembled, at least one of the first and second features extends in a radial direction relative to the other of the first and second features to capture the shield 18. Such an arrangement effectively pinches the shield 18 while preventing the inner and outer barrels 32, 34 from being easily pulled apart during use, which maintains good contact with the shield 18.

In one example retention feature, the inner barrel 32 includes a first feature provided by a circumferential flange 48 that is arranged with respect to second feature provided by a window 38 in the outer barrel 34. The circumferential flange 48 cooperates with the window 38 when fully assembled to provide a stop that prevents slippage or axial movement of the inner and outer barrels 32, 34 with respect to one another in order to capture the shield 18 throughout a designed for pullout forces. Standard crimping operations may be used, and degradation of the connection between the connector 20 and the cable 12 is avoided during use of the cable assembly 10.

Figure 3A:
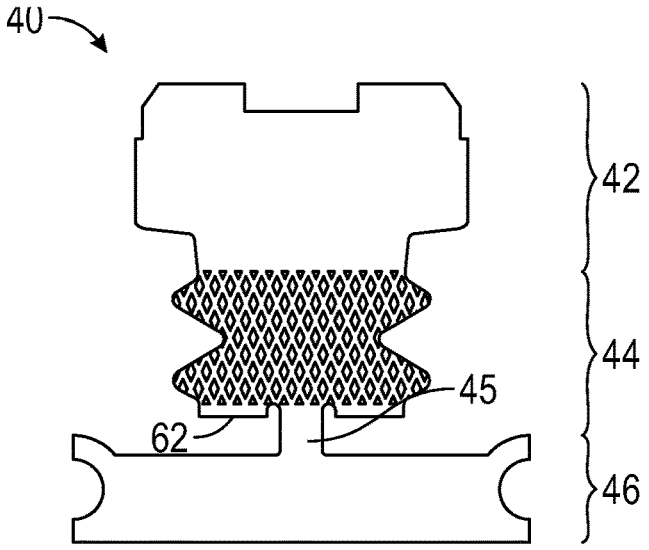
FIG. 3A is a top view of an inner barrel blank.
Figure 3B:
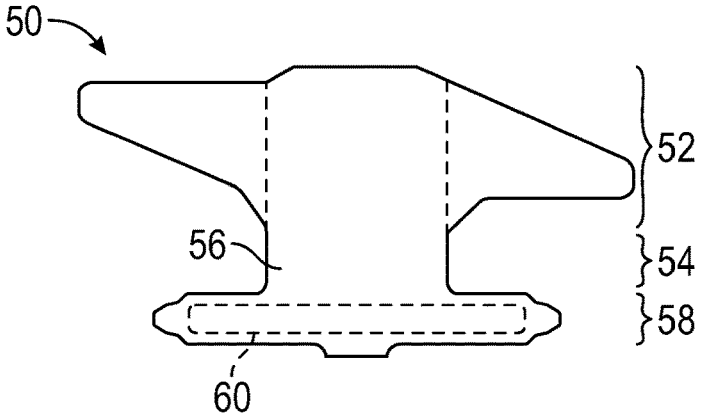
FIG. 3B is a top view of an outer barrel blank.

Example inner and outer barrel blanks 40, 50 are respectively shown in FIGS. 3A and 3B. At least one of the first and second features are provided in the blanks 40, 50. Referring to the inner barrel blank 40, a flat metal stamping is rolled into a cylindrical or oval shape to provide first and second diameter portions 42, 44; the first diameter portion 42 is larger than the second diameter portion 44 in the illustrated example. A carrier strip 46 is joined to the second diameter portion 44 by a tab 45. The carrier strip 46 is sheared from the rest of the inner barrel blank 40 at the tab 45 and discarded during the forming process.

In one example embodiment, the second diameter portion 44 provides an end 62. The end 62 provides the flange 48 that is flared radially outwardly with respect to the second diameter portion 44. When fully assembled, the first diameter portion 42 is joined to the outer housing 22 of the connector 20. It should be understood that the outer barrel 34 may be joined to the outer housing 22 rather than the inner barrel 32 (shown), if desired.

Referring to the outer barrel blank 50, a main body portion 52 is provided as a cylindrical or oval shape. The main body portion 52 is adjoined to a winged portion 58 by a longitudinal portion 56 which is arcuate in shape. The longitudinal portion 56 is narrower than the main body portion 52 and the winged portion 58 such that a window portion 54 is provided that forms the window 38, best shown in FIGS. 2 and 4A. A reinforcing indentation or depression 60 may be provided in the winged portion 58 to provide further rigidity. The winged portion 58 is secured over the sheathing 28 by a crimp, for example.

Figure 4A:
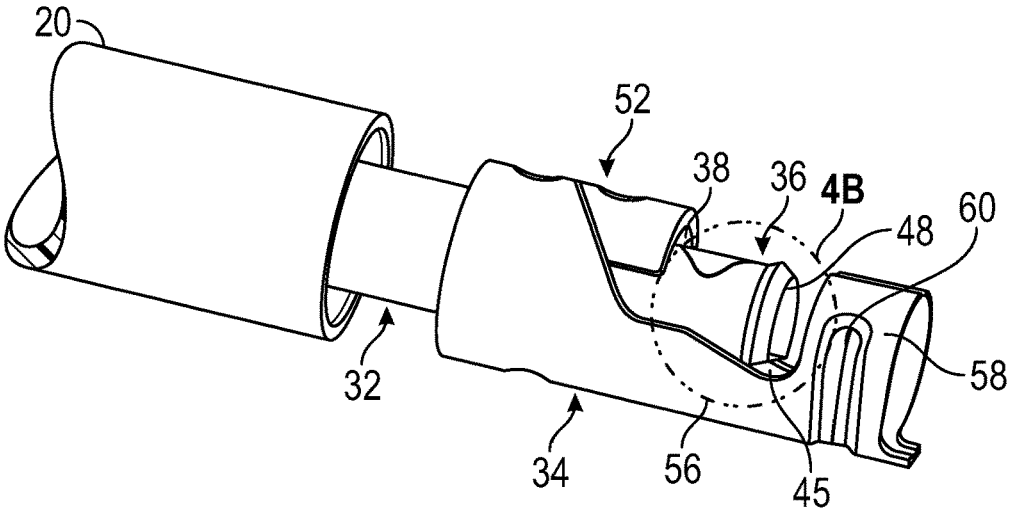
FIG. 4A is a perspective view of the inner and outer barrels arranged coaxially relative to one another with the cable omitted for clarity.
Figure 4B:
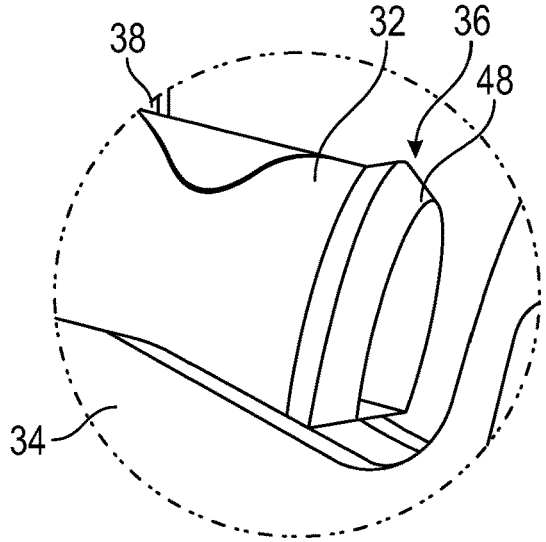
FIG. 4B is an enlarged view of a portion of the inner and outer barrels, illustrating a flange on the inner barrel providing a braid retention feature.
Figure 5:
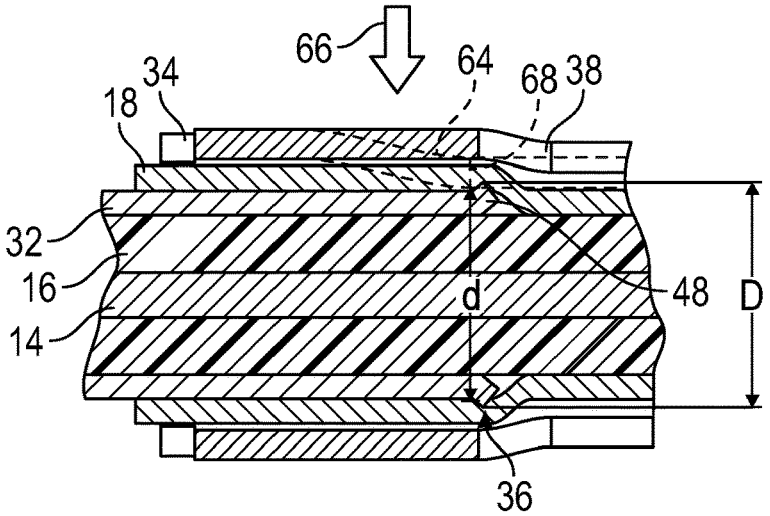
FIG. 5 is an enlarged cross-sectional view of a portion of the inner and outer barrels with a metallic shield retained therebetween.

Referring to FIGS. 4A-5, the retention feature 36 is formed by the flange 48 arranged within the window 38. During assembly, a portion of the outer barrel 34 is plastically deformed by a crimping force 66, as shown in FIG. 5, to provide a crimped portion 64 adjacent to the flange 48. The crimped portion 64 provides an edge 68 that has an innermost diameter d that is smaller than an outermost diameter D of the flange 48. In this manner, the shield 18 is securely retained between the edge 68 and the flange 48 preventing pullout of the shield 18 under axial loads. The crimped portion 64 generates a clamping force on the shield 18 and the inner barrel 32.

Figure 6:
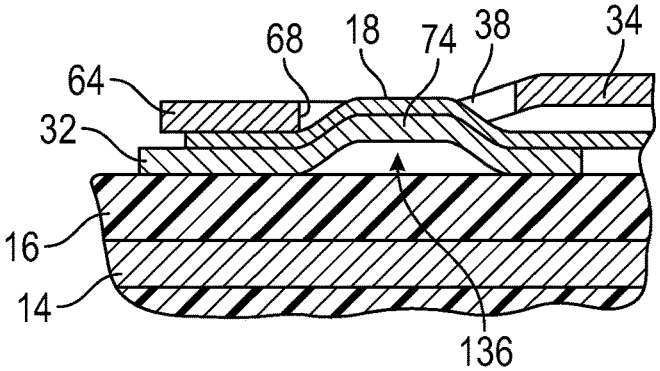
FIG. 6 depicts another example braid retention feature.

Another example configuration is illustrated in FIG. 6. In this example, the retention feature 136 is provided by a protrusion 74 in the inner barrel 32. The edge 68 of the crimped portion 64 is adjacent to the protrusion 74 such that the protrusion 74 and the shield 18 cannot be pulled axially out of the window 38 in the outer barrel 34.

Figure 7A:
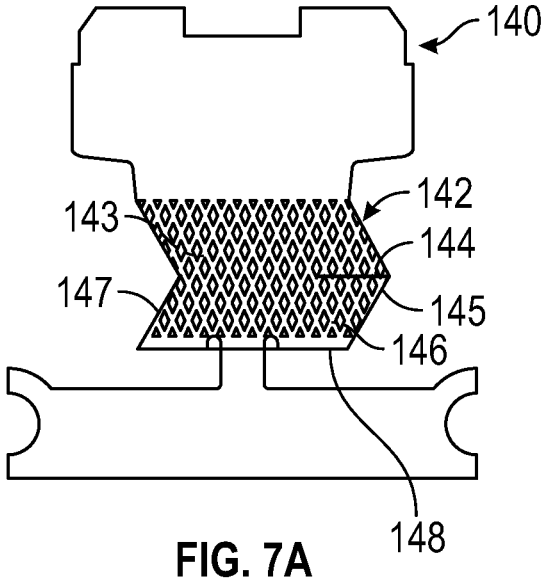
FIG. 7A illustrates another inner barrel blank.
Figure 7B:
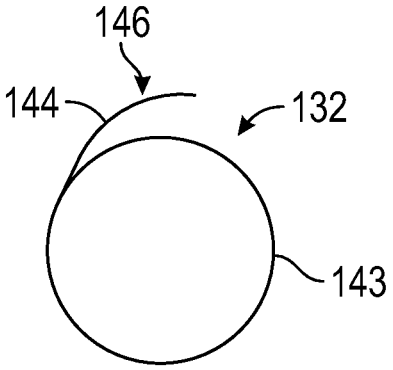
FIG. 7B is an end view of the inner barrel taken along line B-B of FIG. 7C.
Figure 7C:
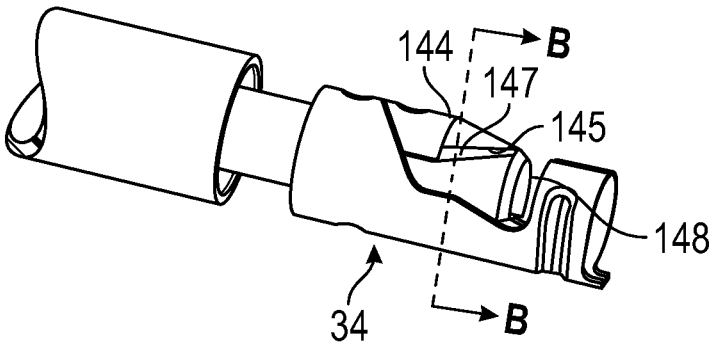
FIG. 7C is a perspective view of the inner barrel of FIG. 7A and the outer barrel of FIG. 4A arranged coaxially relative to one another with the cable omitted for clarity.

Another example arrangement is shown in FIGS. 7A-7C. The inner barrel blank 140 best illustrates the first feature prior to forming the inner barrel 132. A portion 143 of the inner barrel 132 includes an irregularly shaped (e.g., non-linear) circumferential edge 142 forming a body. In the example, the circumferential edge 142 is chevron-shaped. The portion 143 has a sheared edge 144 extending interiorly from the circumferential edge 142. The first feature is provided by the sheared edge 144 extending radially outward to a raised portion 146 relative to the body, as best shown in FIGS. 7B and 7C. In the example, one edge 145 of the portion 143 is adjacent to an opposing edge 147 of the portion 143 when formed into the inner barrel 132. An end 148 of the portion 143 need not include a flange as the end 148 is arranged radially inward with respect to the raised portion 146. The sheared edge 144 is axially blocked by the outer housing 34 to provide the retention feature.

Figure 8A:
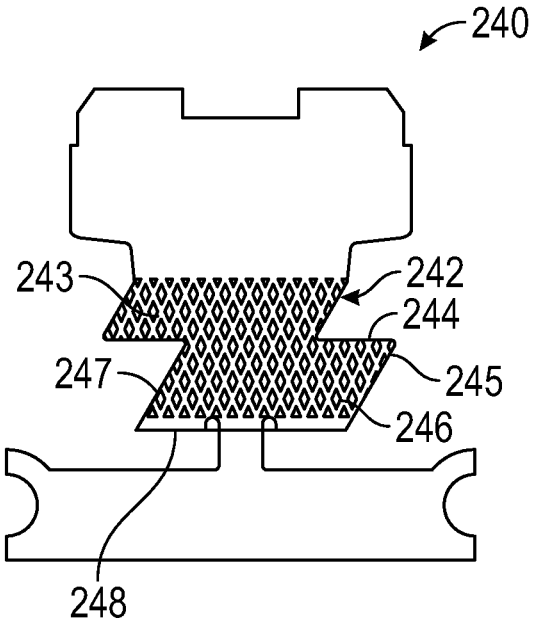
FIG. 8A illustrates another inner barrel blank.
Figure 8B:
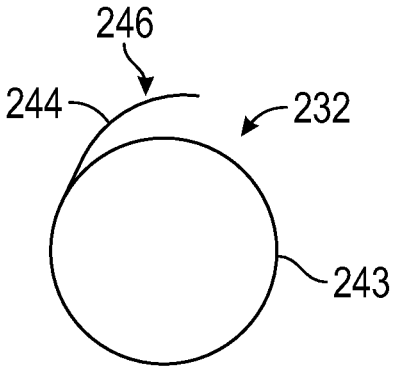
FIG. 8B is an end view similar to that of FIG. 7B, but of the inner barrel formed from the blank shown in FIG. 8A.

Referring to FIGS. 8A-8B, a similar arrangement to FIGS. 7A-7C is shown but with a different inner barrel blank 240 forming the inner barrel 232. In this example, a portion 243 of the of the inner barrel blank 240 includes an irregularly shaped circumferential edge 242 forming the body. In the example, the circumferential edge 242 is Z-shaped. An edge 244 is provided by the circumferential edge 242 rather than a discrete shear. One edge 245 of the portion 243 is adjacent to an opposing edge 247 of the portion 243 when formed into the inner barrel 232. The first feature is provided by the edge 244 extending radially outward to a raised portion 246 relative to the body, as best sown in FIG. 8B. Again, an end 248 of the portion 243 need not include a flange as the end 248 is arranged radially inward with respect to the raised portion 246. The edge 244 is axially blocked by the outer housing to provide the retention feature (similar to FIG. 7C).

Referring to FIGS. 9A-11C, the first features are provided by a window 349, 449, 549 respectively in portions 343, 443, 543 of the inner barrel blanks 340, 440, 540. The inner barrel 332, 432, 532 and its first feature cooperates with the second feature of the outer barrel 334, 434, 534 (formed by outer barrel blanks 350, 450, 550) to provide the retention feature. Rather than the window 349, 449, 549 formed by a cutout in the inner barrel blanks 340, 440, 540, as shown in the Figures, a depression feature formed in the inner barrel 332, 432, 532 may be used to cooperate with the second feature of the outer barrel 334, 434, 534. The captured shield 18 is omitted from the Figures for clarity.

Figure 9A:
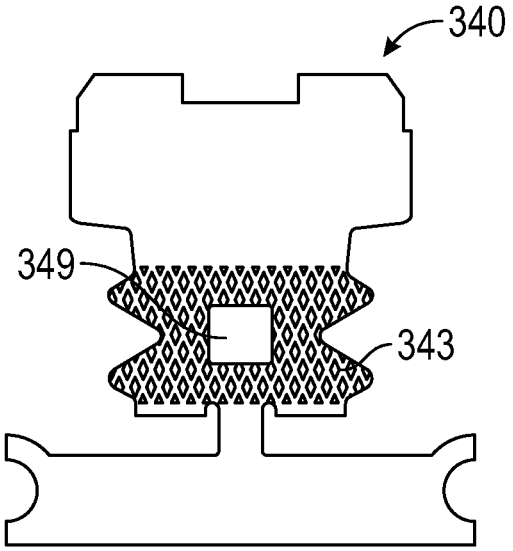
FIG. 9A illustrates yet another inner barrel blank.
Figure 9B:
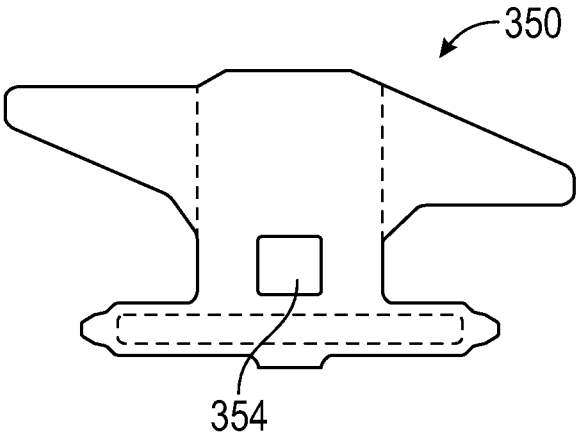
FIG. 9B is of another outer barrel blank.
Figure 9C:
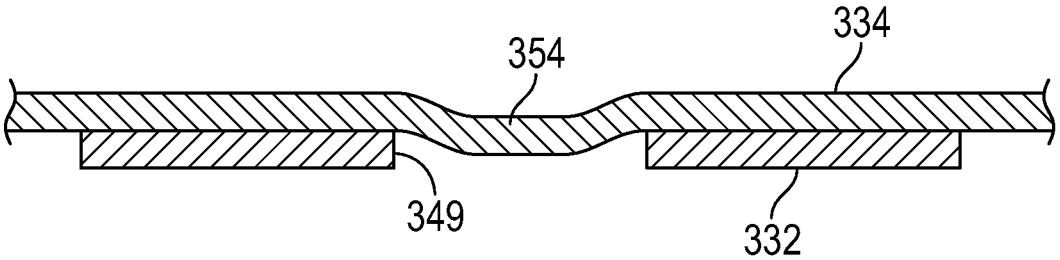
FIG. 9C depicts a partial cross-sectional view of the inner and outer barrels formed from the blanks shown in FIGS. 9A and 9B and arranged coaxially relative to one another with the cable omitted for clarity.
Figure 10A:
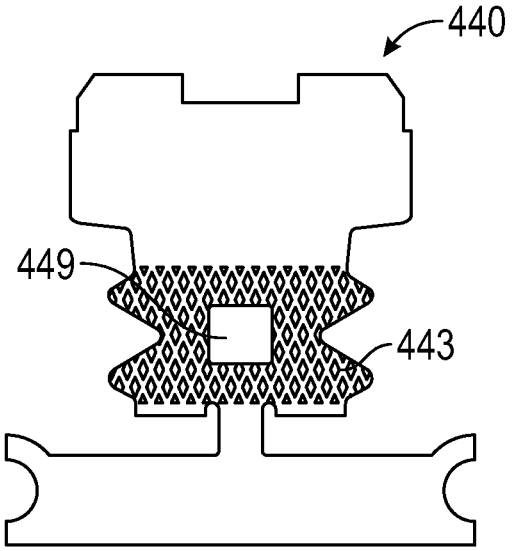
FIG. 10A illustrates yet another inner barrel blank.
Figure 10B:
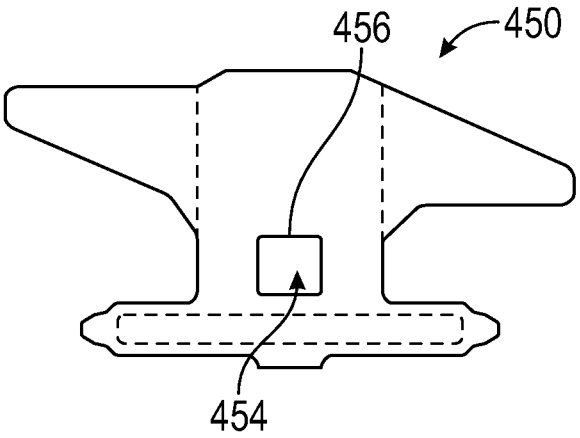
FIG. 10B is of another outer barrel blank.
Figure 10C:
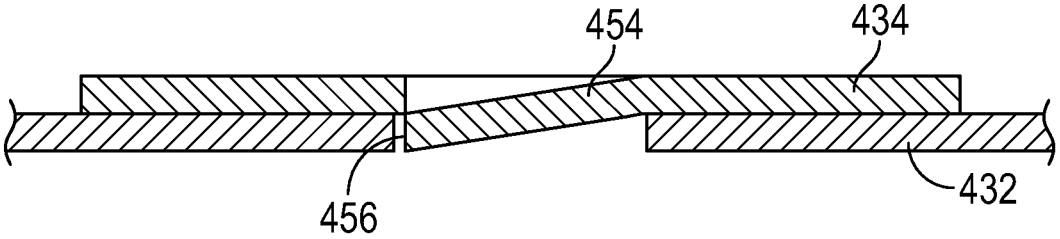
FIG. 10C depicts a partial cross-sectional view of the inner and outer barrels formed from the blanks shown in FIGS. 10A and 10B and arranged coaxially relative to one another with the cable omitted for clarity.
Figure 11A:
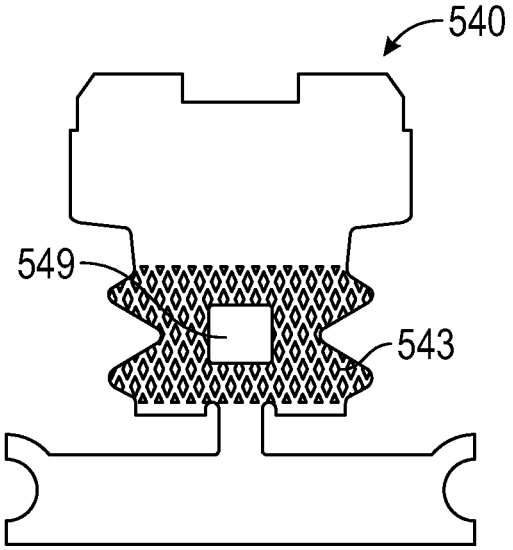
FIG. 11A illustrates still another inner barrel blank.
Figure 11B:
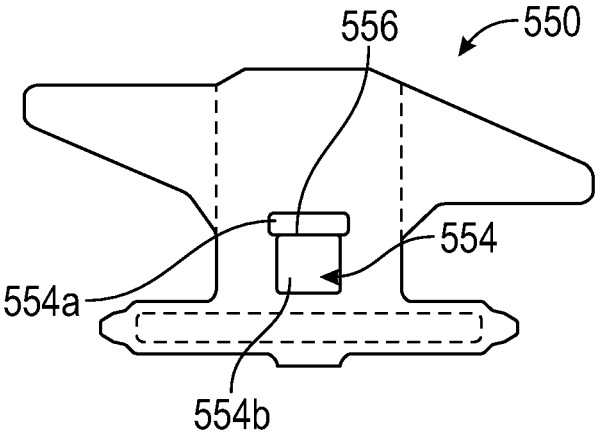
FIG. 11B is of still another outer barrel blank.
Figure 11C:
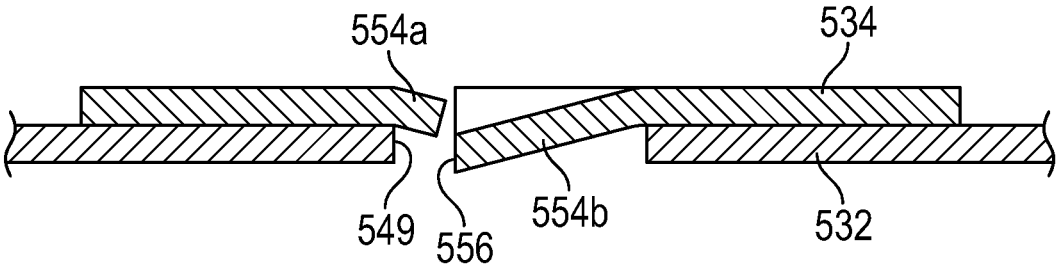
FIG. 11C depicts a partial cross-sectional view of the inner and outer barrels formed from the blanks shown in FIGS. 11A and 11B and arranged coaxially relative to one another with the cable omitted for clarity.

As shown in FIGS. 9B and 9C, the second feature is provided by a depression 354 extending radially inward to the window 349. Referring to FIGS. 10B and 10C, the second feature is provided by a depression 454 having a portion that forms a sheared edge 456. The sheared edge 456 is arranged inboard from a perimeter of an outer barrel blank 450, as shown in FIG. 10B. The example illustrated in FIGS. 11B-11C combines aspects of the embodiments shown in FIGS. 9B and 9C and FIGS. 10B and 10C in that the second feature is provided by a depression 554 having a sheared edge 556 that is provided between opposing sides 554*a*, 554*b* of the depression 554, wherein both of the opposing sides 554*a*, 554*b* extend radially into the window 549.

In operation, first and second features are respectively provided on the inner barrel 32 and the outer barrel 34. One of the first and second features extends radially outward, and the other of the first and second features extends radially inward. The cable assembly 10 is assembled by inserting the cable 12 into the outer barrel 34. An end of the inner barrel 32 is arranged underneath the shield 18. The first and second features are aligned both circumferentially and axially, in the example, to provide the retention features. The retention feature prevents relative axial movement of the inner and outer barrels 32, 34, thus, securely retaining the shield 18.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. A cable assembly comprising:

coaxially arranged inner and outer barrels, the outer barrel overlaps a portion of the inner barrel, the inner and outer barrels respectively include first and second features that cooperate with one another to form a retention feature;

a cable including at least one wire surrounded by an inner insulator covered in a metallic shield, wherein the metallic shield is arranged in between the inner and outer barrels;

wherein the first feature is arranged beneath the metallic shield, and the second feature is arranged over the metallic shield, at least one of the first and second features extends in a radial direction relative to the other of the first and second features to capture the metallic shield with the retention feature; and wherein the first features is provided by a window, and the second feature is provided by a depression extending radially inward to the window, a portion of the depression provides a sheared edge.

2. The cable assembly of claim 1, wherein the metallic shield is provided by a braided or foil sleeve, wherein one of the inner and outer barrels is secured to an electrical connector having an outer housing, and the metallic shield is grounded and secured to the outer housing, wherein the metallic shield is covered in a nonconductive sheathing, and the other of the inner and outer barrels is secured over the nonconductive sheathing.

3. The cable assembly of claim 1, wherein the outer barrel includes a crimped portion provided by a plastically deformed area and that generates a clamping force on the metallic shield and the inner barrel.

4. The cable assembly of claim 1, wherein the sheared edge is arranged inboard from a perimeter of an outer barrel blank.

5. The cable assembly of claim 1, wherein the sheared edge is provided between opposing sides of the portion of the depression, wherein both of the opposing sides extend radially into the window.

6. The cable assembly of claim 1, wherein the inner and outer barrels are each metallic cylindrically-shaped or oval shaped members.

7. The cable assembly of claim 1, wherein the inner and outer barrels are formed from sheet metal blanks, at least one of the first and second features are provided in the blanks.

8. A cable assembly comprising:

coaxially arranged inner and outer barrels, the outer barrel overlaps a portion of the inner barrel, the inner and outer barrels respectively include first and second features that cooperate with one another to form a retention feature;

a cable including at least one wire surrounded by an inner insulator covered in a metallic shield, wherein the metallic shield is arranged in between the inner and outer barrels;

wherein the first feature is arranged beneath the metallic shield, and the second feature is arranged over the metallic shield, at least one of the first and second features extends in a radial direction relative to the other of the first and second features to capture the metallic shield with the retention feature; and wherein a portion of the inner barrel includes an irregularly shaped circumferential edge forming a body, the irregularly shaped circumferential edge has a sheared edge extending interiorly from the circumferential edge, the first feature is provided by the sheared edge extending radially outward relative to the body, the sheared edge is axially blocked by the outer barrel to provide the retention feature.

9. A cable assembly comprising:

coaxially arranged inner and outer barrels, the outer barrel overlaps a portion of the inner barrel, the inner and outer barrels respectively include first and second features that cooperate with one another to form a retention feature;

a cable including at least one wire surrounded by an inner insulator covered in a metallic shield, wherein the metallic shield is arranged in between the inner and outer barrels;

wherein the first feature is arranged beneath the metallic shield, and the second feature is arranged over the metallic shield, at least one of the first and second features extends in a radial direction relative to the other of the first and second features to capture the metallic shield with the retention feature; and wherein a portion of the inner barrel includes an irregularly shaped circumferential edge forming a body, the irregularly shaped circumferential edge has a circumferentially extending portion providing an edge, the first feature is provided by the edge extending radially outward relative to the body, the edge is axially blocked by the outer barrel to provide the retention feature.

10. A method of assembling a cable comprising the steps of:

a) providing first and second features respectively provided on an inner barrel and an outer barrel, wherein at least one of the first and second features extends in a radial direction relative to the other of the first and second features;

b) inserting the cable into the outer barrel;

c) inserting an end of the inner barrel underneath a metallic shield;

d) aligning the first and second features to provide a retention feature; and e) capturing the metallic shield between the first and second features of the inner and outer barrels and preventing relative axial movement of the inner and outer barrels relative to one another, wherein the second feature is a window, and the capturing includes crimping the outer barrel adjacent to the window, wherein the first feature is in the window, and the capturing includes plastically deforming a portion of the outer barrel to provide an innermost diameter that is less than an outermost diameter of the first feature.

11. The method of claim 10, wherein the first feature is provided by a flange at an end of the inner barrel that is flared radially outward.

12. The method of claim 11, wherein the second feature is a window and the first feature is arranged within the window, the flange is provided about a circumference of the end, the flange is axially aligned with the window.

13. The method of claim 10, wherein the second feature is a window and the first feature is arranged within the window, the first feature is provided by a protrusion in the inner barrel that is arranged axially inboard of an end, the protrusion is axially and circumferentially aligned with the window.

14. The method of claim 10, wherein the cable includes at least one wire surrounded by an inner insulator covered in the metallic shield, and step c) includes inserting the end of the inner barrel between the inner insulator and the metallic shield, and wherein step e) includes securing one of the inner and outer barrels to a terminal connector having an outer housing, and wherein the metallic shield is grounded to the outer housing, wherein the cable includes a nonconductive sheathing covering the metallic shield, and the other of the inner and outer barrels are secured over the nonconductive sheathing.

15. The method of claim 10, wherein step d) includes sliding the outer barrel axially over the inner barrel and the metallic shield.

16. The method of claim 10, wherein prior to performing step a), comprising a step of a1) forming the first feature by bending a circumferential flange radially outward on a terminal end of an inner barrel blank.

17. The method of claim 10, wherein prior to performing step a), comprising a step of a1) forming the first feature by deforming a protrusion axially inboard of a terminal end of an inner barrel blank, and wherein step d) includes circumferentially aligning the protrusion with a window providing the second feature.

* * * * *